US006203172B1

(12) United States Patent
Wanuch et al.

(10) Patent No.: US 6,203,172 B1
(45) Date of Patent: Mar. 20, 2001

(54) LOW-TEMPERATURE THEATRICAL LIGHTING SYSTEM

(75) Inventors: Arthur Paul Wanuch, Mississauga; Larry Stan Mosicki, Toronto, both of (CA)

(73) Assignee: PS Production Services Ltd. (CA)

( * ) Notice: Subject to any disclaimer, the term of this patent is extended or adjusted under 35 U.S.C. 154(b) by 0 days.

(21) Appl. No.: 09/361,522

(22) Filed: Jul. 27, 1999

(51) Int. Cl.[7] ..... F21K 21/26

(52) U.S. Cl. ..... 362/260; 225/251; 225/269; 225/319; 225/367

(58) Field of Search ..... 362/269, 319, 362/367, 260, 225, 251

(56) References Cited

U.S. PATENT DOCUMENTS 4,404,619 * 9/1983 Ferguson ..... 362/222
5,012,396 * 4/1991 Costa ..... 362/224
5,172,034 * 12/1992 Brikerhoff ..... 315/307
5,539,281 * 7/1996 Shackle et al. ..... 315/224
5,890,793 * 4/1999 Stephens ..... 362/225
5,962,989 * 10/1999 Baker ..... 315/294

* cited by examiner

*Primary Examiner*—Sandra O'Shea
*Assistant Examiner*—Ali Alavi
(74) *Attorney, Agent, or Firm*—Katten Munich Zavis

(57) ABSTRACT

A low-temperature theatrical lighting system consists of a rectangular frame structure having a pair of opposing tubular frame members; and a number of fluorescent lamps extending in parallel to each other between the frame members. Each frame member includes a number of fluorescent lamp sockets, and each fluorescent lamp is connected to an opposing pair of lamp sockets. The lighting system also includes a fluorescent lamp ballast assembly disposed within at least one of the frame members. The lamp ballast assembly is electrically connected to the lamp sockets and controls the intensity of light emitted from the fluorescent lamps.

4 Claims, 7 Drawing Sheets

LOW-TEMPERATURE THEATRICAL LIGHTING SYSTEM

FIELD OF THE INVENTION

The present invention relates to a lighting system for use in television, motion picture, still photography, and other photographic, cinematographic and theatrical lighting applications. In particular, the present invention relates to a low-temperature high-luminescent light suitable for close-up work on stage, studio and on-location sets.

BACKGROUND OF THE INVENTION

Conventional high-luminescent television, motion picture and theatrical lights have a curved reflective housing and a high intensity lamp mounted in the housing. Typical high-intensity lamps include gas vapour, arc and metal halide. Such high-intensity lamps have a high luminescent output for illuminating a large portion of the set. However, these lamps also emit substantial quantities of heat, making them unsuitable for situations requiring the light to be placed in close proximity to an actor or model. Further, the high intensity lamps are quite fragile and, therefore, must be removed from the reflective housing during transport. In addition, the curved housing tends to focus the heat generated by the lamp around the lamp itself thereby subjecting the lamp structure to increased thermal stress. Over time, this stress can lead to early failure of the lamp.

Attempts have been made to reduce the thermal stress imposed upon the lamp. Typically, these attempts have involved incorporating heat sinks into the reflective housing so as to dissipate the heat generated by the lamp. However, such heat sinks tend to increase the cost of manufacturing the light, while also increasing the difficulty of replacing failed lamps. Further, the heat sinks tend to increase the weight of the light, rendering them top-heavy and difficult to maneuvre into position. Accordingly, there remains a need for a low maintenance lighting system which is suitable for close-up work in television, motion picture, still photography, and other photographic, cinematographic and theatrical lighting applications, and which can be easily maneuvred into position and transported between sets without a high risk of bulb failure.

SUMMARY OF THE INVENTION

According to the invention, there is provided a low-temperature theatrical lighting system which addresses the disadvantages of the prior art theatrical lighting systems. As used in this context, the phrase "theatrical lighting system" is intended to mean a lighting system which is suitable for use in all theatrical applications, including television, motion picture, still photography and for stage, studio and on-location sets.

The low-temperature theatrical lighting system, according to the invention, comprises a frame structure having a window, a first pair of opposing tubular frame members disposed along the perimeter of the window, and a plurality of fluorescent lamp sockets secured to the frame structure. The lighting system also includes a plurality of fluorescent lamps disposed within the window, with each fluorescent lamp being connected to a pair of lamp sockets. The lighting system also includes a fluorescent lamp ballast assembly disposed within at least one of the frame members. The lamp ballast assembly is electrically connected to the lamp sockets and controls the intensity of light emitted from the fluorescent lamps.

In a preferred implementation of the invention, the frame structure comprises a rectangular frame structure having a second pair of frame members coupled to the first pair of frame members. Each of the end frame members of the first frame member pair includes twenty eight standard bi-pin fluorescent lamp sockets, and each of the fluorescent lamps is connected to an opposing pair of the fluorescent lamp sockets. The fluorescent lamps also extend parallel to the second frame member pair and in close proximity to each other to increase the luminescent output of the lighting system. A removable reflective panel is fastened to the frame members for further increasing the luminescent output.

The lamp ballast assembly comprises a number of discrete dimmable electronic ballasts which are disposed within both of the frame members of the first frame member pair. Each dimmable electronic ballast controls a pair of non-adjacent fluorescent lamps. As a result, the electronic ballasts disposed in one of the frame members of the first frame member pair controls one set of fluorescent lamps, while the electronic ballasts disposed in the opposing frame member controls the intervening set of fluorescent lamps. In addition, the lighting system also includes a ballast control system which allows the electronic ballasts disposed in one of the frame members to be controlled independently of the electronic ballasts disposed in the other of the frame members.

Since fluorescent lamps are used instead of the conventional high-intensity lamps, the invention produces sufficient light for use in theatrical applications, but without the dissipation of heat associated with the prior art lighting systems. In addition, since fluorescent lamps are more durable than high-intensity lamps, the invention allows the light to be transported without a high risk of damage to the lamps. Further, since the fluorescent lamp ballasts are electronic and are disposed within the frame itself, the invention provides a light-weight compact source of light which can be readily maneuvered into position.

BRIEF DESCRIPTION OF THE DRAWINGS

The preferred embodiment of the invention will now be described, by way of example only, with reference to the accompanying drawings, in which.

DETAILED DESCRIPTION OF THE PREFERRED EMBODIMENT

Figure 1:
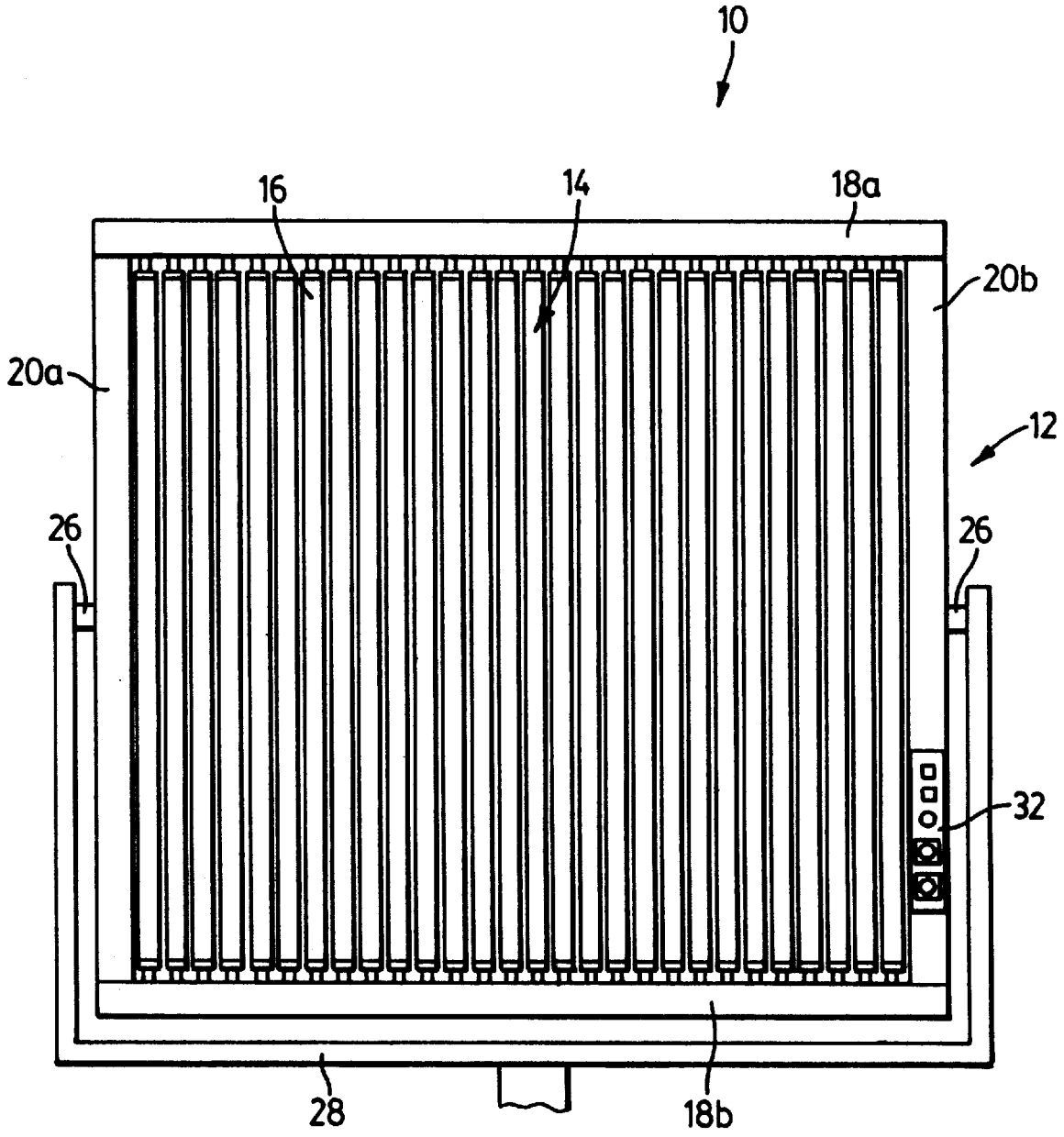
FIG. 1 is a front plan view of the low-temperature theatrical lighting system according to the present invention, showing the rectangular frame structure and the fluorescent lamps.

Turning to FIG. 1, a low-temperature theatrical lighting system, denoted generally as 10, is shown comprising a frame 12 having a central window 14, and twenty eight elongate T12 bi-pin fluorescent light bulbs 16 disposed within the central window 14. The frame 12 comprises a pair of opposing first and second tubular end frame members 18*a*, 18*b*, and a pair of opposing first and second tubular side frame members 20*a*, 20*b* fastened to the end frame members 18*a*, 18*b*. Each of the tubular frame members 18, 20 is disposed along the perimeter of the central window 14, and has an elongate rectangular parallelepiped shape and a depth (as measured from the front of the frame 12 to the rear of the frame 12) of approximately 2.5 inches. This depth provides the frame 12 with a narrow profile so as to allow the lighting system 10 to be positioned in close proximity to walls, ceilings and to fit conveniently behind columns and other obstructions.

Figure 2A:
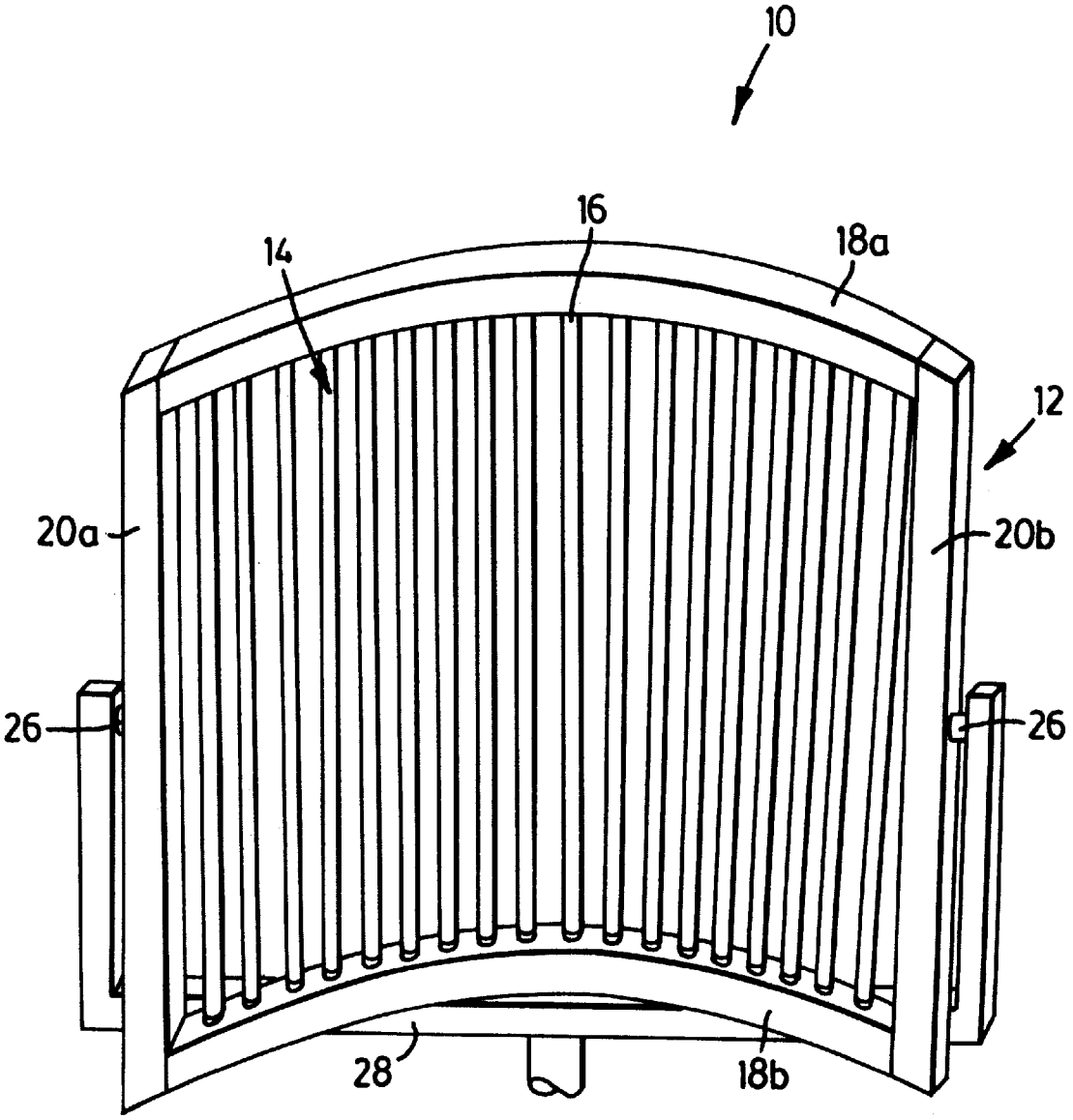
FIG. 2*a* is a front perspective view of one variation of the theatrical lighting system shown in FIG. 1, depicted the frame with a concave shape.
Figure 2B:
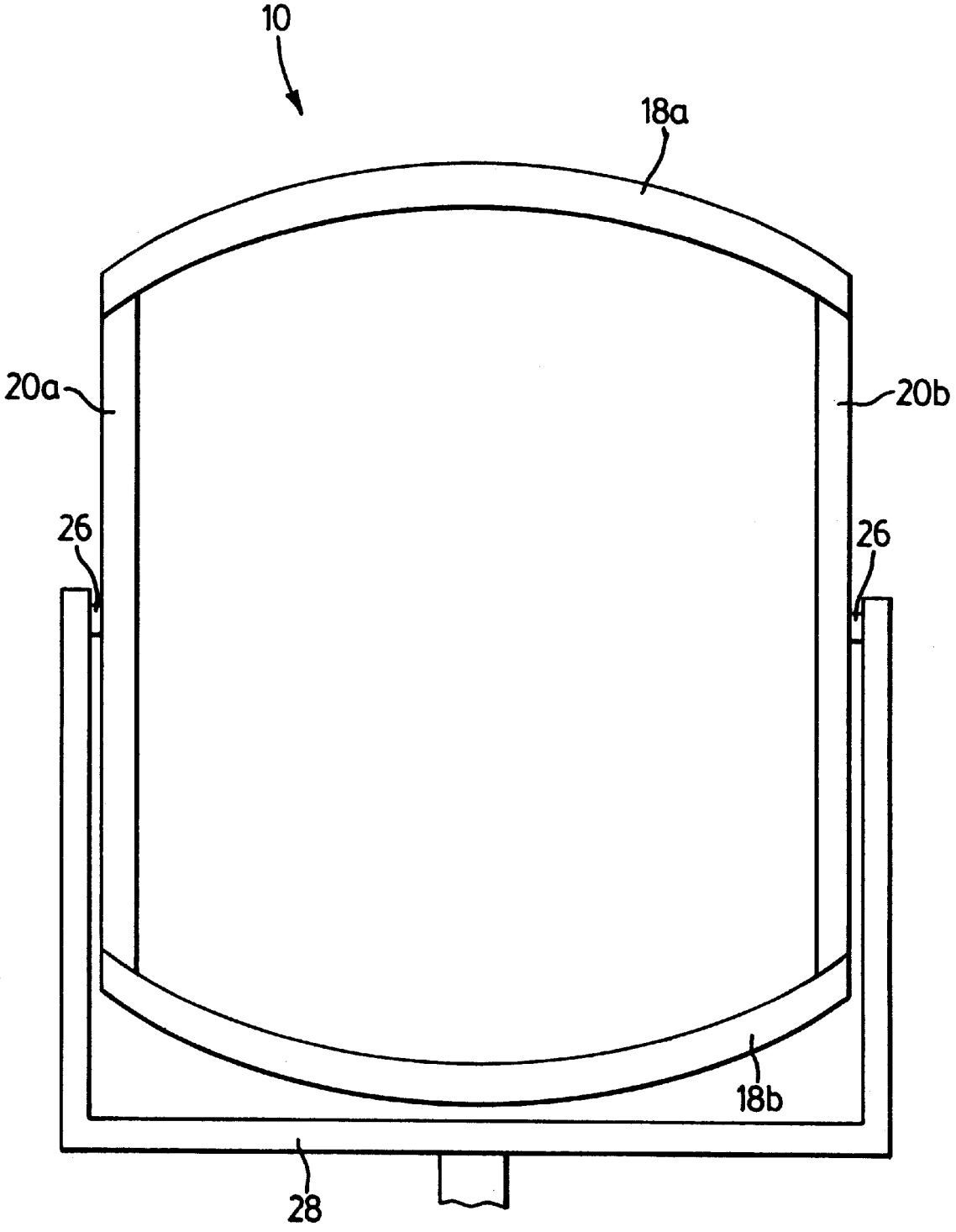
FIG. 2*b* is a front plan view of another variation of the theatrical lighting system, showing the frame with opposing arcuately-shaped end frame members.

As shown in FIG. 1, the first and second end frame members 18*a*, 18*b* are parallel to one another, and the first and second side frame members 20*a*, 20*b* are parallel to each other but perpendicular to the first and second end frame members 18*a*, 18*b*, so as to provide the frame 12 with a generally rectangular parallelepiped shape. However, it should be understood that the frame 12 may adopt other parallelepiped shapes, if desired. Further, as shown in FIG. 2*a*, the end frame members 18 may even adopt an arcuate shape, giving the frame 12 a generally concave/convex shape. In addition, in the preferred embodiment, the end frame members 18*a*, 18*b* are parallel to one another to allow the lighting system 10 to make use of fluorescent light bulbs 14 of all the same length. However, the end frame member 18*a*, 18*b* may instead be disposed at an acute angle to each another or even curved away from each (as shown in FIG. 2*b*) if fluorescent light bulbs of different lengths are to be used.

Figure 3:
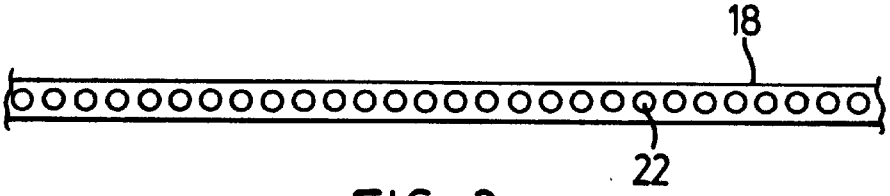
FIG. 3 is a plan view of one of the end frame members of the rectangular frame structure shown in FIG. 1, depicting the fluorescent lamp sockets for retaining the fluorescent lamps therein.
Figure 4:
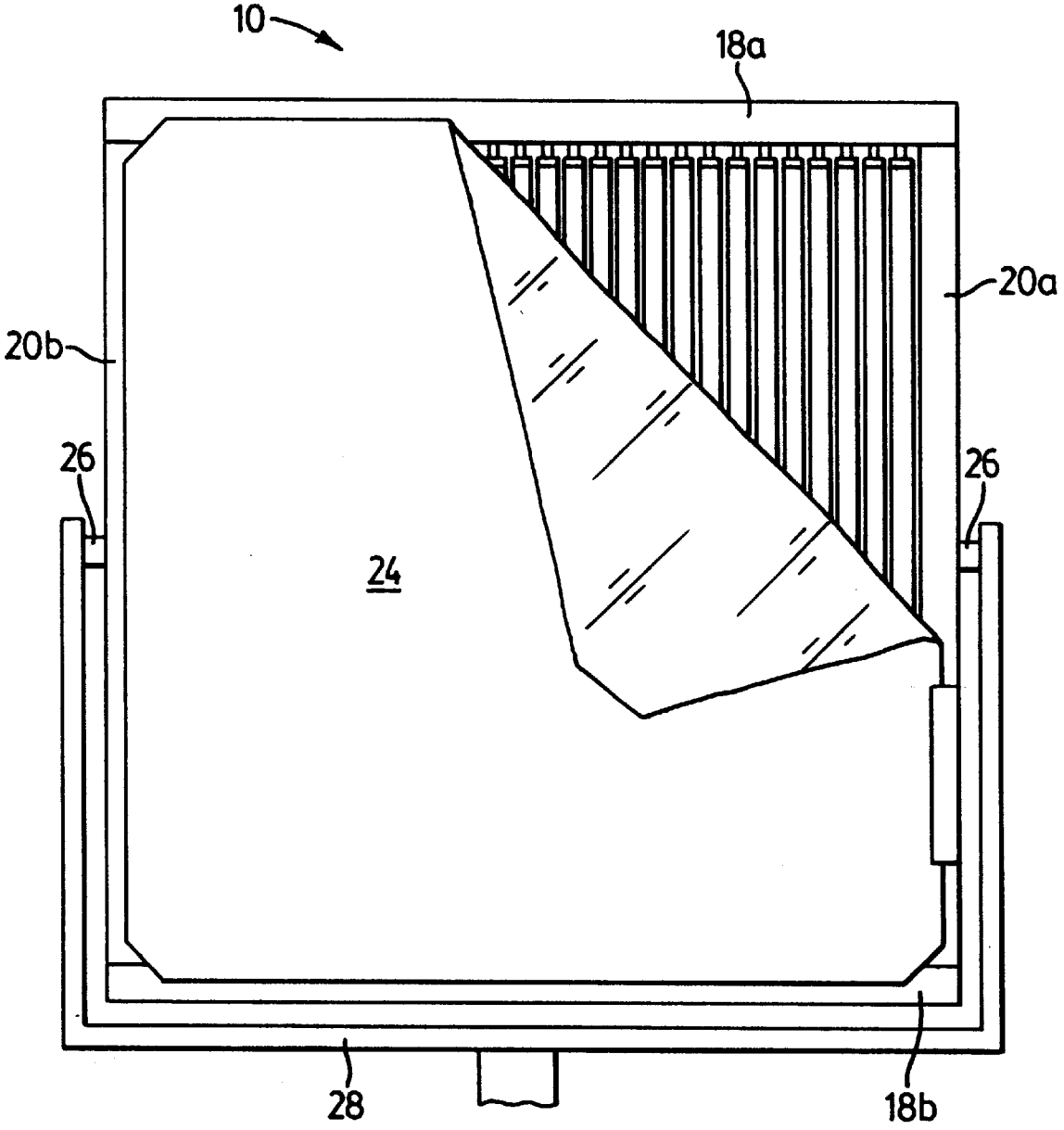
FIG. 4 is a rear plan view of the lighting system depicted in FIG. 1, showing the rectangular frame structure, the fluorescent lamps, and the reflective panel partially pulled away from the frame structure.

The first and second end frame members 18*a*, 18*b* each include twenty eight regularly spaced-apart fluorescent lamp sockets 22 (see FIG. 3). Each fluorescent lamp socket 22 extends from the respective end frame member 18 into the central window 14 of the frame 12 and receives the electrodes of an end of a fluorescent lamp 16. Also, each fluorescent lamp socket 22 provided on the first frame member 18*a* is collinear with a corresponding lamp socket 22 provided on the second frame member 18*b*. As a result, the elongate fluorescent lamps 16 extend parallel to one another and are connected at their respective opposite ends to opposing pairs of the lamp sockets 22. Also, the fluorescent lamp sockets 22 are disposed in close proximity to one another so as to position the fluorescent lamps 16 in close proximity to each other. As will be appreciated, this arrangement serves to maximize the number of fluorescent lamps 16 within the window 14 and thereby to maximize the luminescent output of the lighting system 10. To further increase the luminescent output of the lighting system 10, the rear side of the frame 12 also includes a removable reflective panel 24 (see FIG. 4) fastened to the frame members 18, 20. Similarly, removable colour filters (not shown) may also be fastened to the front side of the frame 12 to provide a variety of lighting conditions.

The side frame members 20 each include a pivot 26 disposed intermediate the ends of the respective side frame member 20. The pivots 26 are engaged by respective pins secured to a moveable base 28 so as to allow the frame 12 to pivot about an axis which extends parallel to the end frame members 18 and which is positioned intermediate the end frame members 18. As will be appreciated, the pivots 26 allow the user to direct the light emitted from the lighting system 10 in the desired direction. The base 28 is only partially shown in FIG. 1, but includes castor wheels at its bottom for moving the lighting system 10 into position.

The lighting system 10 also includes a dimmable fluorescent lamp ballast assembly electrically connected to the fluorescent lamp sockets 22 for controlling the intensity of light emitted from the fluorescent lamps 16. As shown diagrammatically in FIG. 5, the fluorescent lamp ballast assembly comprises a first dimmable fluorescent lamp ballast sub-assembly 30*a* disposed within the first end frame member 18*a* and a second dimmable fluorescent lamp ballast sub-assembly 30*b* disposed within the second end frame member 18*b*.

Preferably, the first and second ballast sub-assemblies 30*a*, 30*b* have equal mass so as to prevent the frame 12 from developing a moment about the pivots 26. However, this restriction could be relaxed by relocating the first and second ballast sub-assemblies 30*a*, 30*b* to the side frame members 20. If desired, the fluorescent lamp sockets 22 could also be relocated to the side frame members 20. Alternately, the fluorescent lamp sockets 22 could remain secured to the end frame members 18, at the expense of extra cabling being required between the ballast sub-assemblies and the fluorescent lamp sockets 22.

It should also be understood that the lighting system 10 need not even include both ballast sub-assemblies 30*a*, 30*b*. Rather, the lighting system 10 could include only one of the ballast sub-assemblies 30, if desired. This latter variation is generally not advantageous, however, since the unbalanced frame 12 would develop a moment about the pivots 26. However, this problem may be overcome by relocating the single ballast sub-assembly from the end frame member to the side frame member, as discussed above.

Figure 5:
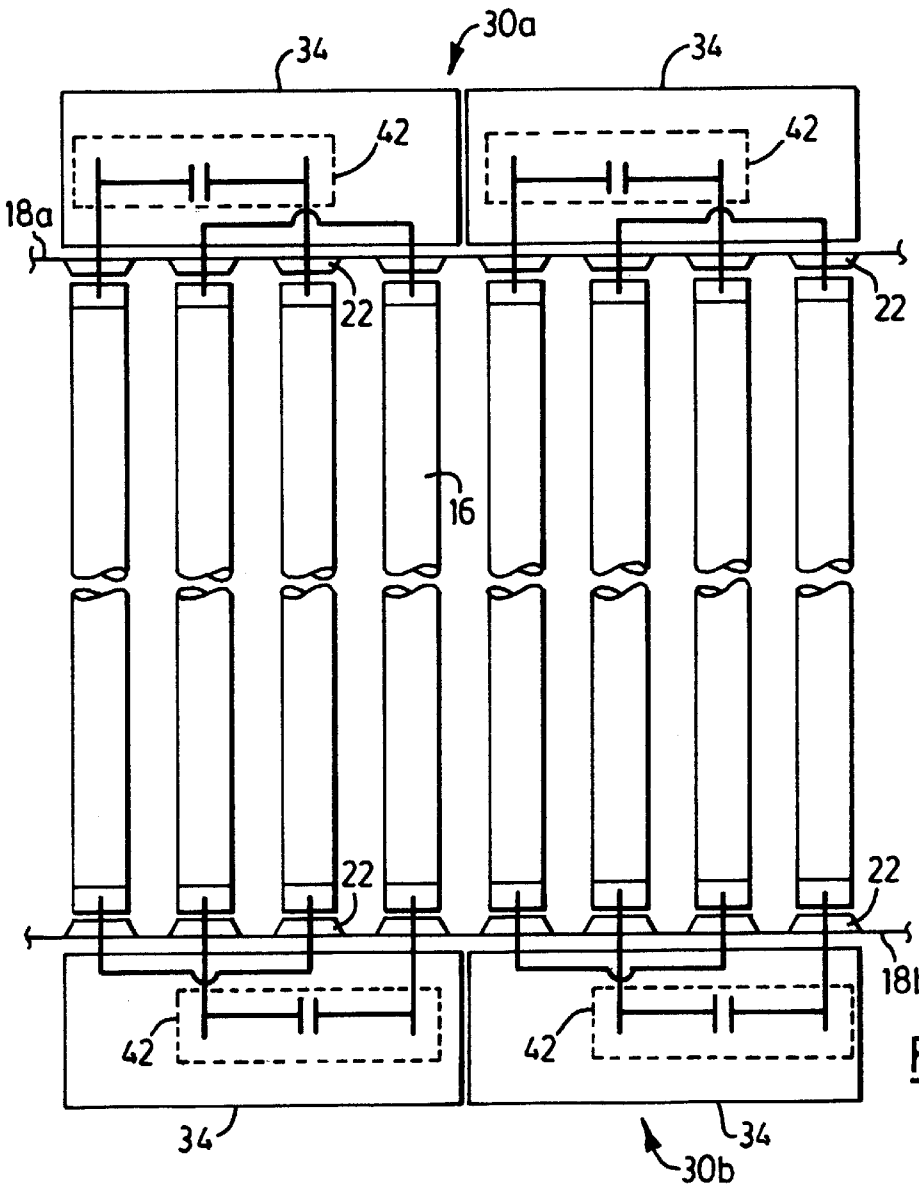
FIG. 5 is a diagrammatic view of the rectangular frame structure, showing the electronic ballasts disposed therein.

As shown in FIG. 5, the first ballast sub-assembly 30*a* controls alternate ones of the fluorescent lamps 16, while the second ballast sub-assembly 30*b* controls the intervening fluorescent lamps 16. The dimmable ballast sub-assemblies 30 are connected to a ballast control system (not shown) which is accessible through a console 32 provided on the second side frame member 20*b*. The console 32 allows the user to vary the luminescent output of the lighting system 10, as desired, by controlling the dimmable fluorescent lamp ballast sub-assemblies 30. Of course, other fluorescent lamp to ballast sub-assembly relationships may be established. For instance, instead of the first ballast sub-assembly 30*a* controlling the first, third, fifth, seventh, etc. fluorescent lamps 16 and the second ballast sub-assembly 30*b* controlling the second, fourth, sixth, eighth, etc. fluorescent lamps 16, as described above, the first ballast sub-assembly 30*a* could control the first, second, fifth, sixth, etc. fluorescent lamps 16 etc. while the second ballast sub-assembly 30*b* controls the third, fourth, seventh, eighth, etc. fluorescent lamps 16, if desired. However, this latter variation may not be particularly advantageous since the light cast by the lighting system 10 might not be particularly uniform.

The ballast sub-assembly 30*a* is connected to the console 32 independently of the ballast sub-assembly 30*b* so as to allow the ballast subassembly 30*a* to be controlled, via the console 32, independently of the ballast subassembly 30*b*. As a result, the user may extinguish the fluorescent lamps 16 coupled to the first ballast sub-assembly 30*a*, for instance, while varying the intensity of light emitted from the fluorescent lamps 16 coupled to the second ballast sub-assembly 30*b*. As will be appreciated, with only half of the fluorescent lamps 16 active, the user is able to produce smaller incremental changes in luminescent output than with all of the fluorescent lamps active. Accordingly, when operated in this mode, the lighting system 10 provides the user with more precise control over luminescent output.

Figure 6:
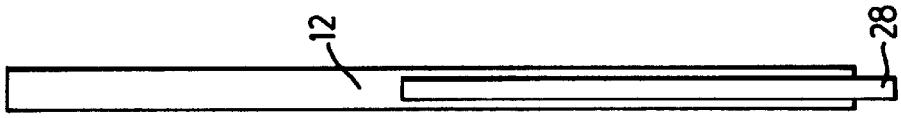
FIG. 6 is a side view of the low-temperature lighting system.

To minimize the weight of the lighting system 10 and to allow the fluorescent lamp ballast sub-assembly 30 to fit within the small confines (see FIG. 6) of the end frame members 18, each fluorescent lamp ballast sub-assembly 30 comprises a number of discrete dimmable electronic fluorescent lamp ballasts 34, of the type well known to those skilled in the art and sold for example by Axiomatic Technologies Corporation of Mississauga, Ontario, Canada, instead of the conventional magnetic fluorescent lamp ballast. The electronic ballast 34 is shown diagrammatically in FIG. 7. Although FIG. 7 shows certain electronic components used in the electronic ballast 34, it should be understood that FIG. 7 is only intended to provide a depiction of the various functional elements of the electronic ballast 34.

Figure 7:
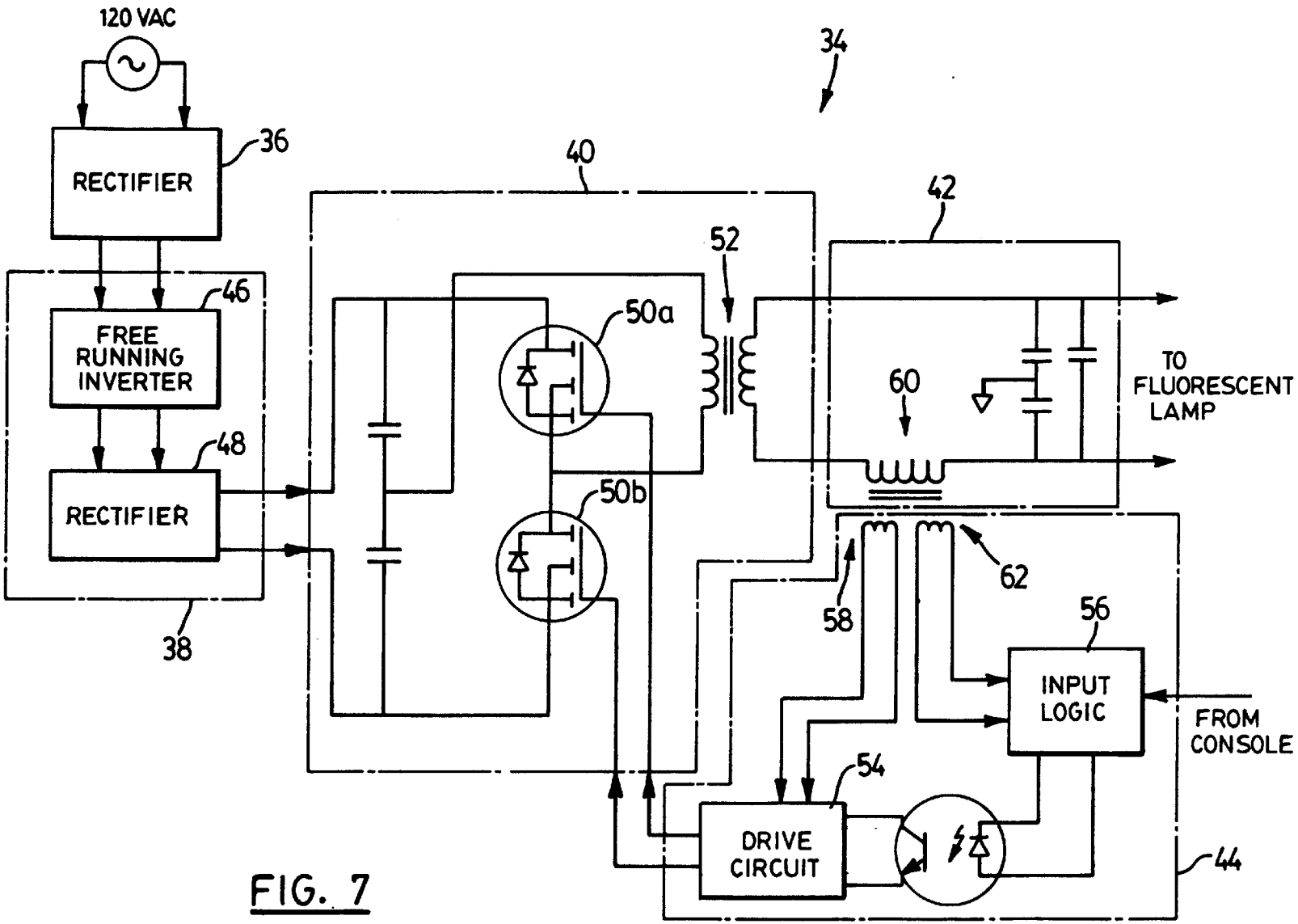
FIG. 7 is a block diagram showing the functional components of the electronic ballasts.

As shown in FIG. 7, each electronic ballast 34 is supplied by a 120 volt 60 Hz AC source and comprises an AC/DC voltage rectifier 36 connected to the 120 volt source, a voltage-boost circuit 38, a DC/AC inverter 40, an output stage 42, and a control system 44 controlled by the console 32. The voltage-boost circuit 38 is connected at its input to the DC output of the rectifier 36, and includes a free-running DC/AC inverter stage 46 and a rectifier stage 48 connected to the output of the inverter stage 46 for amplifying the DC output voltage delivered by the rectifier 36 to a magnitude sufficient for proper operation of the fluorescent lamps 16. This value is approximately 335 volts DC for the standard T12 bi-pin fluorescent lamp. As is commonly found in voltage-boost circuits, the voltage-boost circuit 38 also corrects the power factor of the output of the inverter stage 46 to maximize the power transfer to the fluorescent lamps 16.

The DC/AC inverter 40 is connected at its input to the DC output of the voltage-boost circuit 38, and includes a pair of electronic switches 50*a*, 50*b* and an isolation transformer 52 connected between the point of common coupling of the electronic switches 50 and the input of the output stage 42. As will be apparent, the isolation transformer 52 serves to isolate the output stage 42 and the fluorescent lamps 16 from the 120 volt AC source and the output of the inverter 40.

The output stage 42 comprises a series-resonant parallel-loaded tank circuit connected between the output of the isolation transformer 52, and a heater stage (not shown) for coupling to the cathode heater terminals of the fluorescent lamps 16 (through the fluorescent lamp sockets 22) for maintaining the cathodes at a minimum temperature sufficient for electron emission through the fluorescent lamps 16.

The control system 44 comprises a drive circuit 54 which establishes the gating signals necessary for proper operation of the electronic switches 50, and input logic 56 which is optically-coupled to the drive circuit 54 for controlling the switching frequency of the electronic switches 50, as dictated by the console 32. The control system 44 also includes a first current sensor 58 coupled to the ballast inductor 60 of the output stage 42 for disabling the drive circuit 54 should the current through the fluorescent lamp 16 fall below a minimum threshold necessary to maintain flicker-free operation. A second current sensor 62 is coupled between the ballast inductor 60 and the input logic 56 for fault detection purposes.

In normal operation, the output stage 42 of the electronic ballast 34 is forced to oscillate at high frequency by the switching action of the inverter 40. In order to vary the luminescent output of the fluorescent lamp 16, the user varies the switching frequency of the inverter 40 through the console 32. As the switching frequency moves towards or away from the resonant frequency of the output stage 42, the output voltage applied to the fluorescent lamp 16 from the output stage 42 also changes, thereby causing the luminescent output of the fluorescent lamp 16 to change. Alternately, in one variation the luminescent output of the fluorescent lamp 16 is controlled by pulse width modulating the output voltage of the inverter 40.

As shown in FIG. 5, the tank circuit output of the output stage 42 of each electronic ballast 34 is connected to a pair of non-adjacent fluorescent lamp sockets 22. However, the opposing fluorescent lamp sockets 22 of the opposing electronic ballast 34 are connected together. As a result, each electronic ballast 34 controls the luminescent output of one pair of non-adjacent series-connected fluorescent lamps 16. Further, the heater stage of each electronic ballast 34 is coupled to the cathode heater terminals (through the fluorescent lamp sockets 22) of those fluorescent lamps 16 being controlled by the electronic ballast 34, and to the cathode heater terminals of those fluorescent lamps 16 being controlled by the opposing electronic ballast 34. Therefore, series operation of the fluorescent lamps 16 is made possible without the necessity of extending conductors through the side frame members 20 from the electronic ballast 34 disposed in one of the end frame members 18 to the fluorescent lamp sockets 22 disposed in the opposing end frame member 18. Alternately, in one variation each pair of non-adjacent fluorescent lamps 16 are connected in parallel to each other, and each electronic ballast 34 controls the luminescent output of one pair of non-adjacent parallel-connected fluorescent lamps 16.

Figure 8B:
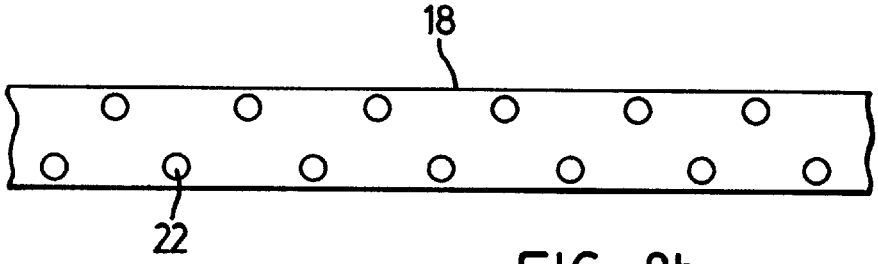
FIG. 8*b* is a plan view of one of the end frame members of the variation shown in FIG. 8*a*.
Figure 8A:
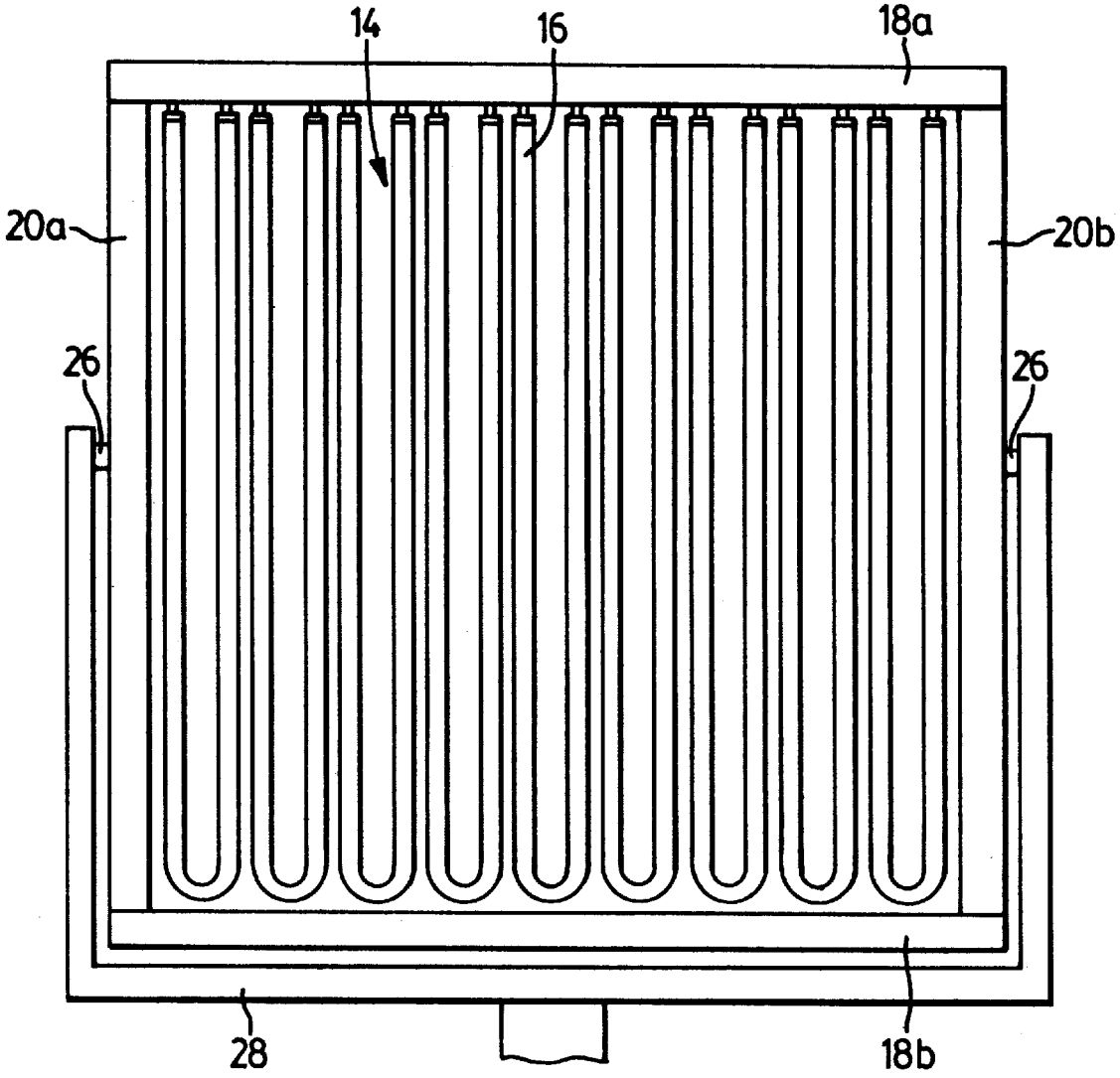
FIG. 8*a* is a front plan view of another variation of the theatrical lighting system, showing the frame with U-shaped fluorescent lamps.

As discussed above, both end frame members 18 include a number of fluorescent lamp sockets 22. However, other arrangements of fluorescent lamp sockets 22 may be utilized without departing from the scope of the invention. For instance, in one variation, shown in FIG. 8*a*, the fluorescent lamp sockets 22 are eliminated from one of the end frame members 18, and the elongate fluorescent lamps 16 are replaced with U-shaped fluorescent lamps 16 which have their electrodes at a common end thereof. To maintain a sufficient number of fluorescent lamps within the window 14, the fluorescent lamp sockets 22 are staggered from the axis of the end frame member 18, as shown in FIG. 8*b*.

The foregoing description of the preferred embodiment is intended to be illustrative of the present invention. Those of ordinary skill will be able to envision certain additions, deletions and/or modifications to the described embodiment which nevertheless fall within the scope or spirit of the invention as defined by the appended claims.

We claim:

1. A low-temperature theatrical lighting system comprising:

a frame structure comprising (i) a windows (ii) a first pair of opposing tubular frame members, and (iii) a second pair of opposing frame members secured to the first pair frame of members, the frame members being disposed along a perimeter of the window;

a plurality of fluorescent lamp sockets secured to each said frame member of the first pair of frame members;

a plurality of fluorescent lamps disposed within the window, each said fluorescent lamp extending parallel to one another and being connected to an opposing pair of the fluorescent lamp sockets;

a plurality of dimmable electronic ballasts disposed within each said frame member of the first pair of tubular frame members for controlling an intensity of light emitted from the fluorescent lamps, each said ballast being electrically connected to a non-adjacent pair of the fluorescent lamp sockets; and a reflective panel removable secured to the frame members for selectively directing a beam of light emitted from the fluorescent bulbs, each said frame member of the second pair of frame members including a pivot for allowing the frame structure to pivot freely about an axis for directing the beam of light emitted.

2. The lighting system according to claim 1, wherein the lighting system includes a ballast control system coupled to the ballasts for controlling the ballasts disposed within one of the frame members of the first pair of frame members independently of the ballasts disposed within the other of the frame members of the first pair of frame members.

3. A low-temperature theatrical light housing comprising:

a frame structure comprising (i) a window, (ii) a first pair of opposing tubular frame members, and (iii) a second pair of opposing frame members secured to the first pair frame of members, the frame members being disposed along a perimeter of the window;

a plurality of fluorescent lamp sockets secured to each said frame member of the first pair of frame members for receiving a plurality of fluorescent lamps therein, a plurality of dimmable electronic ballasts disposed within each said frame member of the first pair of tubular frame members for controlling an intensity of light emitted from the fluorescent lamps, each said ballast being electrically connected to a non-adjacent pair of the fluorescent lamp sockets; and a reflective panel removable secured to the frame members for selectively directing a beam of light emitted from the fluorescent bulbs, each said frame member of the second pair of frame members including a pivot for allowing the frame structure to pivot freely about an axis for directing the beam of light emitted.

4. The lighting system according to claim 3, wherein the lighting system includes a ballast control system coupled to the ballasts for controlling the ballasts disposed within one of the frame members of the first pair of frame members independently of the ballasts disposed within the other of the frame members of the first pair of frame members.

* * * * *